US006098215A

United States Patent [19]

Goodwin

[11] Patent Number: 6,098,215

[45] Date of Patent: Aug. 8, 2000

[54] TOILET SEAT LIFTING DEVICE

[76] Inventor: Robert Goodwin, 114 Oak St., Dunstable, Mass. 01827

[21] Appl. No.: 09/208,032

[22] Filed: Dec. 9, 1998

Related U.S. Application Data

[60] Provisional application No. 60/067,775, Dec. 10, 1997.

[51] Int. Cl.[7] ..... A47K 13/00

[52] U.S. Cl. ..... 4/667; 4/254

[58] Field of Search ..... 4/254, 667; 297/DIG. 10

[56] References Cited

U.S. PATENT DOCUMENTS

| | | | |
|---|---|---|---|
| D. 332,304 | 1/1993 | Lefebvre et al. . | |
| 3,250,569 | 5/1966 | Gaffney | 297/DIG. 10 X |
| 3,473,174 | 10/1969 | Cool . | |
| 3,479,087 | 11/1969 | Burke . | |
| 3,914,806 | 10/1975 | Pearce . | |
| 3,925,833 | 12/1975 | Hunter . | |
| 4,031,576 | 6/1977 | Epstein . | |
| 4,168,552 | 9/1979 | Austin . | |
| 4,185,335 | 1/1980 | Alvis . | |
| 4,291,422 | 9/1981 | Shoemaker et al. . | |
| 4,587,678 | 5/1986 | Love et al. . | |
| 4,726,079 | 2/1988 | Signori et al. . | |
| 4,884,841 | 12/1989 | Holley . | |
| 4,907,303 | 3/1990 | Baird . | |
| 4,924,531 | 5/1990 | Square . | |
| 4,951,328 | 8/1990 | Potvin . | |
| 5,027,446 | 7/1991 | Robertson . | |
| 5,031,251 | 7/1991 | Williams et al. . | |
| 5,063,617 | 11/1991 | Ward et al. . | |
| 5,155,873 | 10/1992 | Bridges . | |
| 5,199,113 | 4/1993 | Glasow et al. . | |
| 5,309,583 | 5/1994 | White et al. . | |
| 5,312,157 | 5/1994 | Logan, Jr. . | |
| 5,323,497 | 6/1994 | Lih et al. . | |
| 5,477,574 | 12/1995 | Skoe . | |
| 5,588,162 | 12/1996 | Robinson . | |
| 5,592,703 | 1/1997 | Jones et al. . | |
| 5,626,389 | 5/1997 | Logan, Jr. . | |
| 5,630,236 | 5/1997 | Mesin . | |
| 5,661,858 | 9/1997 | House et al. . | |

*Primary Examiner*—Charles E. Phillips
*Attorney, Agent, or Firm*—Ernest V. Linek; Banner & Witcoff, Ltd.

[57] ABSTRACT

The present invention features a seat-lifting device for use with commonly available toilets, which is easily manufactured, easily installed in a household about the toilet. Such a seat-lifting device also would be simple and safe to use by the persons who desire to use the toilet. Such a seat-lifting device also would repeatedly, reliably and safely move the person from and between the upright and seated positions. Also featured are methods related thereto. A seat-lifting device according to the present invention features a toilet seat, a motor, a drive mechanism and seat lift linkage. The seat lift linkage is operably interconnected to the motor by the drive means and also is interconnected to the toilet seat. In this way, motion of the motor in a first direction causes the seat lift linkage to move the toilet seat from a one position, corresponding to a seated position, to a second position, an elevated position. Correspondingly, motion of the motor in another or reverse direction causes the toilet seat to move from the second position to the first position. More particularly, the seat-lifting device includes a support frame, that supports each of the motor, toilet seat, drive means and seat lift linkage and more specifically pivotably supports the toilet seat so the motion of the motor in either direction causes the toilet seat to pivot or rotate about a portion of the support frame between the first and second positions.

8 Claims, 2 Drawing Sheets

TOILET SEAT LIFTING DEVICE

CROSS-REFERENCE TO RELATED APPLCIATION

This application claims priority from copending U.S. Provisional Application Ser. No. 60/067,775, filed Dec. 10, 1997, the disclosure of which is hereby incorporated herein by reference.

FIELD OF INVENTION

The present invention relates to seat assemblies for toilets or water closets and more particularly to lifting seat assemblies or devices and more specifically to lifting seat assemblies or devices in which the height and angle of the surface on which the person sits an be varied to assist those using the toilet or water closet.

BACKGROUND OF THE INVENTION

Toilets commonly found in homes, hospitals, nursing homes and convalescent homes are generally to low for invalids, the weak and infirm (e.g., post-operative patients), arthritic and the elderly to use, both in seating themselves and in rising from the seated position. It is thus, not uncommon for these categories of people to require assistance by others in becoming seated or rising therefrom. In addition to being embarrassing to the person, such assistance ties up resources (e.g., nurses or orderlies) so they unavailable to perform other tasks. Also, if such resources are handling other matters and thus are not readily available, then the person cannot use the toilet as and when desired. The foregoing also applies to some persons who otherwise might be reasonably ambulatory and can take care of themselves but who are unable to use the commonly available toilet because of their particular circumstances.

There also is an increasing emphasis on having patients return to their home for convalescence instead of remaining in a hospital or rehabilitation or convalescence facility. As such, members of the family or aids have to be around to assist a person in seating on the toilet and rising therefrom. This can be particularly embarrassing for both the person and family member if the family member happens to be of the opposite sex.

If the person foregoes the assistance of another, it is possible that the person might become injured, for example by falling down when rising from the seated position. Also, if the person is at home, it is possible that the injured person may not be easily treated and leading to them being re-admitted to a hospital. Thus, the person's period of convalescence can be extended as well as creating the possibility of aggravating the existing condition.

It is well known that such persons can use toilets that have elevated seats, because there is less difficulty for them in reaching the seated position because the person's center of gravity is not appreciably lowered. The maintenance of the person's center of gravity also assists them in rising from the toilet seat. However, while such seats are effective they are not a practical solution for every situation. For example, it is not practical to remove an existing conventional toilet from a house and install a new toilet having an elevated seat when one is home for a short-term convalescence or following surgery.

In an effort to overcome the short-comings with conventional toilets or water closets, numerous and different types of structures or devices have been developed in an attempt to raise the seating surface and/ or make the seating surface movable. Thereby providing an aid to an individual, moving between the seated and standing positions when using a toilet. Such prior art devices, however, have various shortcomings such as being complex, expensive, involving special plumbing requirements, and/or not being particularly portable.

PRIOR ART PATENTS

There is described in U.S. Pat. No. 3,473,174 a forward-tilting toilet seat raising mechanism including a frame which is bolted to a conventional toilet seat bowl at the lugs provided for a conventional toilet seat. A seat is attached to the frame, and a reversible motor drives two hydraulic assemblies which are pivotally attached to the seat-supporting member and a base support.

There is described in U.S. Pat. No. 3,479,087 a forward-tilting toilet seat-lifting device having a section of pneumatic flexible tubing which is inflated by a compressor. A toilet seat hinged at the front portion thereof to a toilet bowl is elevated by the inflated tubing, and the seat retreats to its original position when a relief valve in the pneumatic tubing is opened.

There is described in U.S. Pat. No. 4,587,678 a forward-tilting lifting device including a stationary frame and a seat frame pivotally coupled to the stationary frame. Also provided are a single, ball-screw motor and a lift arm for pivoting the seat frame.

There is described in U.S. Pat. No. 4,884,841 a forward-tilting toilet seat having a pair of side frames and a seat frame, the latter being tilted by means of pneumatic or hydraulic pistons or a screw jack.

There is described in U.S. Pat. No. 5,309,583 a toilet seat tilting device including a complex set of articulated linkages to tilt the seat and elevate a pair of side arms simultaneously by means of a linear actuator such as a pneumatic or hydraulic cylinder and piston.

There is described in U.S. Pat. No. 5,626,389 a toilet seat lifting device having a four-bar linkage and a spring. A locking mechanism holds the seat in the seated position and a pneumatic tube dampens the seat's motion.

There is described in U.S. Pat. No. 5,323,497 a tilting toilet seat lifting mechanism employing a gear rack mounted to the rear of a toilet bowl in front of the flush water tank that is situated rearward of a conventional orientation.

Other prior art devices generally relating to lifting seat assemblies and devices for aiding one's use of toilets and the like are described in U.S. Pat. Nos. 5,661,858; 5,630,236; 5,592,703; 5,588,162; 5,477,574; 5,312,157; 5,199,113; 5,155,873; 5,063,617; 5,031,251; 5,027,446; 4,951,328; 4,924,531; 4,907,303; 4,726,079; 4,291,422; 4,185,335; 4,168,552; 4,031,576; 3,925,833 3,914,806; and U.S. Design Pat. No. 332,304.

To the extent necessary, the disclosures of the foregoing patents are hereby incorporated herein by reference.

It thus would be desirable to provide a seating lifting device for use with toilets or water closets that is portable and easy to use. It would be particularly desirable to provide such a device that would be easy to install with existing conventional toilets and plumbing arrangements particularly in comparison to that for prior art devices. In particular, a device that did not have to be erected around the toilet and water closet. Such seat lifting devices preferably would be simple in construction and less costly than prior art devices and the installation of such devices would not require highly skilled installers.

SUMMARY OF THE INVENTION

The present invention features a seat-lifting device for use with commonly available toilets, which is easily manufactured, easily installed in a household about the toilet. Such a seat-lifting device also would be simple and safe to use by the persons who desire to use the toilet. Such a seat-lifting device also would repeatedly, reliably and safely move the person from and between the upright and seated positions. Also featured are methods related thereto.

A seat-lifting device according to the present invention features a toilet seat, a motor, a drive mechanism and seat lift linkage. The seat lift linkage is operably interconnected to the motor by the drive means and also is interconnected to the toilet seat. In this way, motion of the motor in a first direction causes the seat lift linkage to move the toilet seat from a one position, corresponding to a seated position, to a second position, an elevated position. Correspondingly, motion of the motor in another or reverse direction causes the toilet seat to move from the second position to the first position. More particularly, the seat-lifting device includes a support frame, that supports each of the motor, toilet seat, drive means and seat lift linkage and more specifically pivotably supports the toilet seat so the motion of the motor in either direction causes the toilet seat to pivot or rotate about a portion of the support frame between the first and second positions.

In specific embodiments, the drive means includes a motor output sprocket, a drive sprocket, a plurality of power transfer sprockets, a power transfer axle, a plurality of drive axles, a drive chain and a plurality of power transfer chains. The motor output sprocket is secured to the output shaft of the motor and also is interconnected to the drive sprocket by means of the drive chain. The drive sprocket and one power transfer sprocket are secured to one drive axle. A power transfer sprocket also is secured to another drive axle and to each end of the power transfer axle.

A power transfer chain interconnects respectively the power transfer sprocket at one end of the power transfer axle and the power transfer sprocket secured to one drive axle. Another power transfer chain interconnects respectively the power transfer sprocket at the other end of the power transfer axle and the power transfer sprocket secured to another drive axle. In this way, the motion of the drive chain causes each of the drive axles to rotate at the same time and at the same rotational speed by means of the power transfer sprockets and the power transfer axle.

The seat lift linkage includes a plurality of lower arms and upper arms respectively, each having first and second ends. Pairs of arms comprising, respectively, one lower arm and one upper arm are pivotably interconnected to each other at the first end thereof. The second end of each lower arm is secured to the drive axles, for example by means of a key type arrangement, so the corresponding drive axle rotates the second end of each lower arm. The second end of each upper arm is pivotably interconnected to the toilet seat at one end thereof, more specifically the end opposite to the point at which the toilet seat is pivotably interconnected to the support frame. Whereby selective operation of the motor by the user cause this end of the toilet seat to be selectively raise or lowered.

Other aspects and embodiments of the invention are discussed below.

BRIEF DESCRIPTION OF THE DRAWINGS

For a fuller understanding of the nature and desired objects of the present invention, reference is made to the following detailed description taken in conjunction with the accompanying drawing figures wherein like reference character denote corresponding parts throughout the several views and wherein.

DETAILED DESCRIPTION OF THE PREFERRED EMBODIMENT

Figure 1:
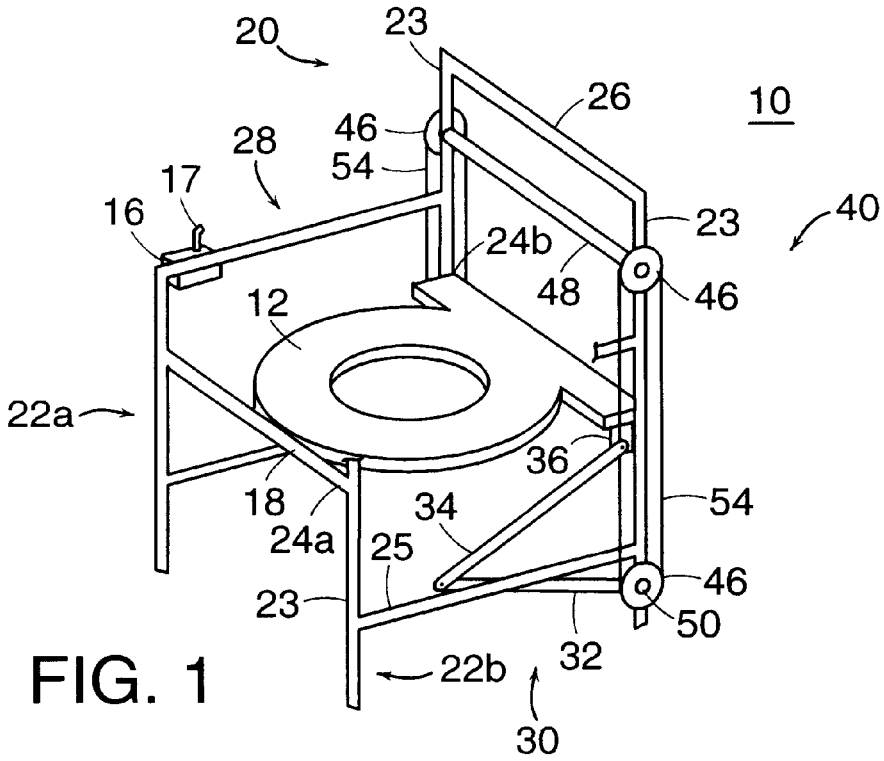
FIG. 1 is an axonometric view of a seat-lifting device according to the present invention with one sidearm removed for clarity.
Figure 2:
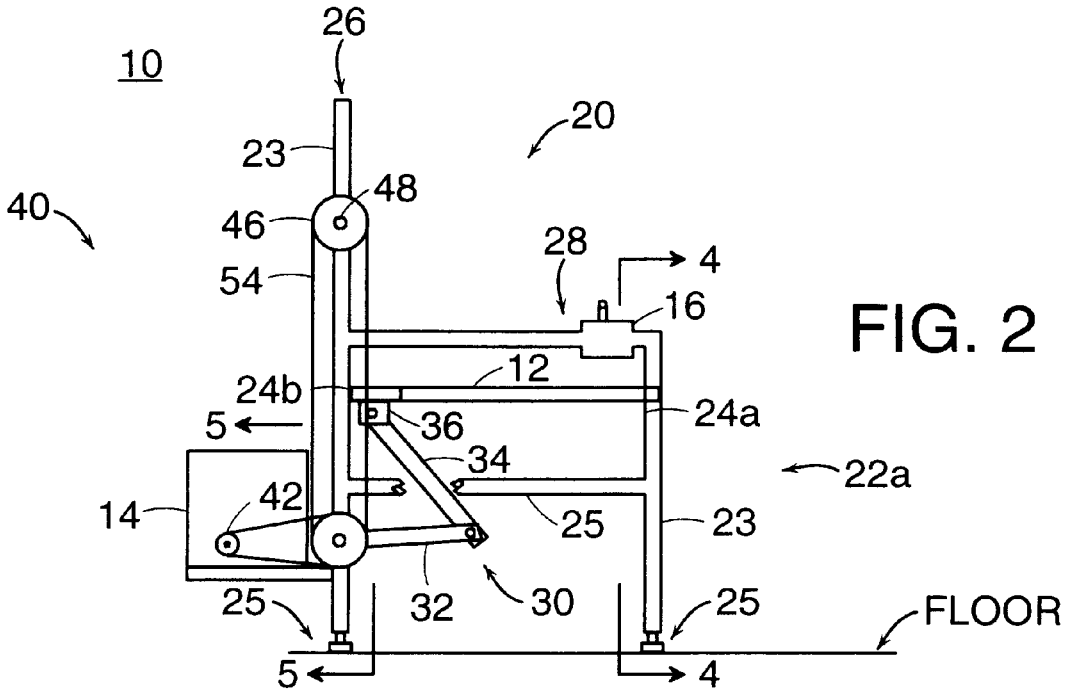
FIG. 2 is a left side view of the seat-lifting device of FIG. 1 with a partial breakaway for clarity.
Figure 3:
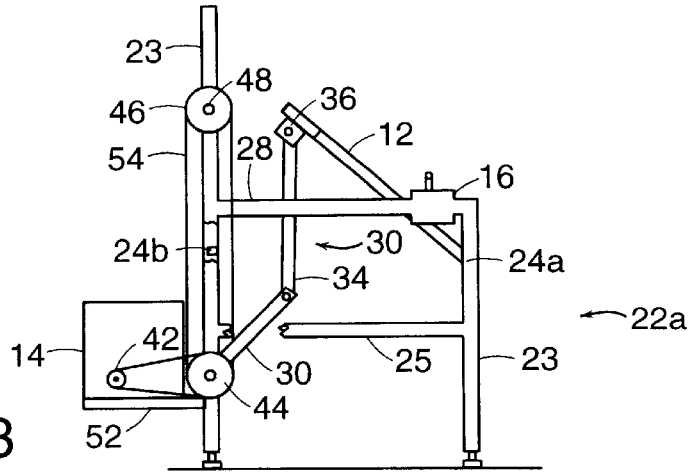
FIG. 3 is a left side view of the seat-lifting device of FIG. 1 when the seat is in the raised position, with partial breakaways for clarity.
Figure 4:
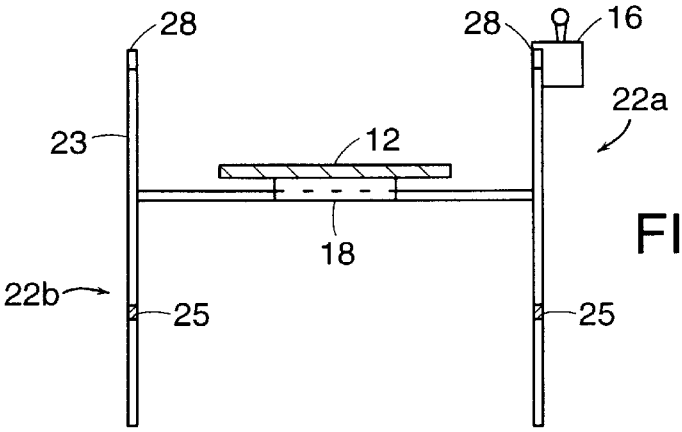
FIG. 4 is an elevation view of the seat-lifting device of FIG. 2 taken along line 4—4.
Figure 5:
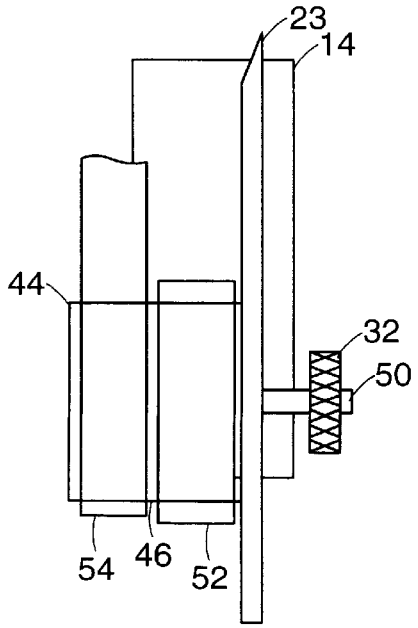
FIG. 5 is an elevation view of a portion of the seat-lifting device of FIG. 2 taken along line 5—5.

Referring now to the various figures of the drawing wherein like reference characters refer to like parts, there is shown in FIGS. 1–5 a seat-lifting device 10 according to the present invention for use with a conventional toilet (not shown). It is within the scope of the present invention, however, that the seat-lifting device 10 be adaptable for use with other styles and configurations of toilets. FIGS. 2 and 3 further include partial breakaways so certain elements or features of the seat-lifting device 10 are more clearly seen.

The seat-lifting device 10 includes a support frame 20, a toilet seat 12, seat-lifting linkage 30, motor 14, and a drive means 40 that driveably interconnects the motor 14 and the seat-lifting linkage 30. In more specific embodiments, the seat-lifting device 10 includes a control box 16 that is affixed to the support frame 20 and a hinge mechanism 18 that pivotably interconnects the toilet seat 12 to a portion of the support frame 20. The control box 16 is electrically interconnected to the motor 14 via wires (not shown) so a user can selectively actuate the motor (e.g., the direction of rotation). Such a seat-lifting device allows a user to selectively and pivotably raise and lower the toilet seat 12 as hereinafter described.

The support frame 20 is a stationary structure having sufficient rigidity and strength so as to support the load (e.g., weight) imposed by an individual when seated upon the toilet seat 12 and any loadings imposed by the individual when moving to and from the seated and upright position. As shown more clearly in FIGS. 1 and 4, the support frame 20 includes left and right side members 22*a,b* a front and back cross members 24*a,b* and a top back cross member 26.

In an exemplary embodiment, the support frame is formed from tubular members such as aluminum, steel or any other material that is capable of providing the requisite strength and stiffness including non-metallic materials such as fiberglass re-enforced nylon. The tubular members can be hollow or solid and may have a circular cross section or other geometric shape. This is not a limitation, as the support frame or the portions thereof can be formed as a unitary structure or from other structural elements (e.g. a side members formed from box type structures).

More particularly, each of the left and right side members 22*a,b* are formed from a plurality of vertically extending members and a plurality of cross brace members that extend therebetween In an illustrative embodiment, each side member 22*a,b* includes two vertically extending members 23 that form respectively a portion of the front and back of the support frame 20, a lower cross-brace member 25 that extends therebetween and an upper cross brace member that preferably is also configured so to function as a handle 28 or hand rail. The handrail or handle 28 is used by a person when going to/from the seated and upright position. In more particular embodiments, each handle 28 further includes a handgrip or textured surface to aid the user in gripping the handle.

The left and right side members 22*a, b* are interconnected by means of the front and back cross members 24*a,b,* where the front cross member 24*a* extends between the vertically extending members 23 of each side member 22*a,b* at the front of the support frame 20. Similarly, the back cross member 24*b* extends between the vertically extending members 23 of each side member 22*a,b* at the back of the support frame 20. Additionally, the top back cross member 26 extends between the vertically extending members 23 of each side member 22*a,b* at the back of the support frame 20.

The front and back cross members 24*a,b* also support the toilet seat when in the seated or rest position. As such, the front and back cross members 24*a,b* are positioned or located so the toilet seat 12 is above the top surface of the toilet bowl. Additionally, the front and back members 24*a,b* and the top back cross member 26 have a length such that the left and right side members 22*a,b* are disposed generally in parallel and on either side of the toilet bowl so the toilet seat is generally positioned over the toilet bowl.

In an exemplary embodiment, the various members comprising the support frame 20 are sized and arranged so the handles are positioned about 27 inches above the surface of the floor and are approximately 8½ inches above the toilet seat 12 when the toilet seat is in its rest position. Also, in the exemplary embodiment the left and right side members 22*a,b* are spaced about 20 inches apart.

In a more particular embodiment, and with specific reference to FIG. 2, each of the left and right side members 22*a,b* further includes a plurality of footpads 25. The footpads 25 are affixed to the vertically extending members 23 of each side member using any of a number of methods or techniques known to those skilled in the art, such as threading and bonding. In an illustrative embodiment, each footpad 25 includes a threaded member that threadably engages a threaded aperture in each vertically extending member. In this way, the height and level of the toilet seat 12 and/or handles 28 can be adjusted by a user, for example to adjust for an uneven floor surface. Alternatively or additionally, each vertically extending member 23 may be configured so as to adjustable lengthwise, such as by means of a telescoping section, to adjust the height and level of the toilet seat 12 and/or handles 28.

The toilet seat 12 is pivoted at its point of attachment to the front cross member 24*a* so that it can move pivotably back and forth from a first position, the rest position, as shown in FIG. 2 to a second position, the elevated and inclined position, as shown in FIG. 3. In an illustrative embodiment, a hinge 18 is attached to the toilet seat 12 proximate its front end (see FIG. 1) and to the front cross member 24*a* (see FIG. 4) so the toilet seat can pivotably move about the front cross member 24*a*. It is within the scope of the present invention, however, to use any means available and known to those skilled in the art for allowing such pivoting motion and/ or allowing the toilet seat to move back and forth between the first and second positions. Additionally, it is within the scope of the present invention for the front end of the toilet seat to be elevated upwardly when it moves from the first position to the second position.

As indicated above, the seat-lifting device includes a drive means 40 that driveably interconnects the motor 14 and the seat-lifting linkage 30. The drive means 40 includes a motor output sprocket 42, a drive sprocket 44, four power transfer sprockets 46, a power transfer axle 48, two drive axles 50, an input drive chain 52 and two power transfer chains 54. The motor output sprocket 42 is secured to the output shaft of the motor 14 and is interconnected to the drive sprocket 44 by means of the input drive chain 52. The motor output sprocket 42 and the drive sprocket 44 are respectively sized so as to control the speed by which the toilet seat 12 is upwardly lifted from the first position to the second position. In an exemplary embodiment, the ratio of the diameters of the motor output sprocket 42 and the drive sprocket 44 is 2:1.

As shown more clearly in FIG. 1, the power transfer axle 48 passes through the two vertically extending members 23 located at the back of the support frame 20. In a preferred embodiment, the power transfer axle 48 is disposed so it is above the toilet seat 12. Such a configuration allows the seat-lifting device 10 of the present invention when fully assembled to be moved so it straddles the toilet bowl. This is not a limitation, however, on the placement and location of the power transfer axle 48. For example, it can be disposed below the toilet seat and so it passes through the vertically extending members 23 at the front of the seat-lifting device 10. Alternatively, a bearing structure can be secured to the vertically extending members 23 so the power transfer axle passes through the bearing structure in lieu of passing through the vertically extending members 23.

A power transfer sprocket 46 is respectfully secured to each of the two drive axles 50 and to each end of the power transfer axle 48. Also, the power transfer sprocket 46 secured to each drive axle 50 is interconnected to the power transfer sprocket 46 secured to each end of the power transfer axle 48 by means of a power transfer chain 54. Additionally, the drive sprocket 44 is secured to the one of drive axles 50. In this way, the rotation of the drive sprocket 44 in either a clockwise or counter-clockwise direction cause each of the power transfer sprockets 46 secured to each drive axle 50 to rotate in a corresponding fashion and at the same rate. This assures that both sides of toilet seat 12 are being raised at the same time and at the same rate of speed.

The power transfer axle 48 and each of the drive axles 50 are rotatably supported as each passes through the vertically extending members 23 using any of a number of means known to those skilled in the art such as bearings and the associated bearing support structure. In an exemplary embodiment, each drive axle is rotatably supported by means of captive bushings and stop collars on each side (not shown) and the power transfer axle 48 is rotatably supported at each end by means of captive bushings and stop collars on each side. Although the foregoing refers to sprockets and chains as the means for rotatably driving each of the drive axles 50 and power transfer axle 48 it is within the scope of the present invention for any means known to those skilled in the art for imparting the rotational energy and force of the motor 14 to the seat lift linkage including toothed belts and gears.

The motor 14 is an electrical motor, such as fractional horsepower gear motor, that is sized so it can generate the required rotational speed and force necessary to repeatedly, reliably and safely raise the toilet seat 12 from the first to the second position, while subject to the loadings imposed by a person to be seated on the toilet seat. In an exemplary embodiment, the motor 14 is a ¼ HP electrical gear motor such as that manufactured by the Bodine Electric Company. The motor 14 is mounted to one of the vertically extending members 23 using for example a mounting plate so that it is maintained in fixed relation to the drive axle 50 located on that side of the support frame 20. Also, the supporting mechanism for the motor 14 is arranged and configured so as to be capable of withstanding the loads impose thereon while the motor 14 is raising and lowering the toilet seat 12 between the first and second positions.

The seat lifting linkage 30 includes two lower arms 32 and two upper arms 34, each arm having respectively first and second ends. The first end of each lower arm 32 is pivotably interconnected or secured to the first end of the upper arm 34. The second end of the lower arm 32 is secured to the drive axle 50, as shown more clearly in FIG. 5, and the second end of the upper arm 34 is pivotably interconnected or secured to a tab 36 extending downwardly from the toilet seat 12. Such an arrangement of the lower and upper arms 32, 34 operably interconnects both drive axles 50 and the two downwardly extending tabs provided on the toilet seat 12. Thus, rotation of the drive axles 50, responsive to the rotational motion of the motor 14, cause the first end of both lower arms 32 to move in a generally upwardly direction. This generally upward motion in turn causes the back of the toilet seat 12 to move upwardly, thus causing the toilet seat to pivot about the hinge 18.

In more specific embodiments, the motor 14 and/or the shift linkage 30 includes limit switches or mechanical stops so as to limit the upward motion of the back end or back of the toilet seat 12. In this way, the motor 14 does not over rotate and possibly damage the seat lift linkage 30. Additionally, the seat lifting linkage 30 and/or the motor 14 includes limit switches and/or mechanical stops to limit the downward motion of the of the toilet seat 12. In this way, the motor 14 does not cause the lower arms 32 to pull the toilet seat below the first position. The limit switches and/or mechanical stops can be any of a number or switches and/or mechanical mechanisms known and/or available to those skilled in the art for such a use.

To use the seat-lifting device 10 of the present invention, a person actuates or moves the lift control switch 17 of the lift control box 16 in a predetermined fashion (e.g. tilts the switch forward) so as to raise the toilet seat 12 to the second position, if not already in this position. The person then moves the lift control switch 17 in another predetermined fashion (e.g., tilts switch backward) so as to cause the toilet seat 12 to be lowered to the first position. Thereafter, the lift control switch 17 is moved so as to cause the seat to move to the second position. The lift control switch 17 also is preferably configured so the user can actuate the switch so the toilet seat 12 is elevated to an intermediate position between the first and second positions. The lift control switch 17 is any of a number of commonly available switches that can control the motor 14 as hereinabove described.

Although a preferred embodiment of the invention has been described using specific terms, such description is for illustrative purposes only, and it is to be understood that changes and variations may be made without departing from the spirit or scope of the following claims.

What is claimed is:

1. A toilet seat lifting device comprising:

(a) a toilet seat, (b) a motor, (c) a drive mechanism, and (d) seat lift linkage;

wherein the seat lift linkage is operably interconnected to the motor by the drive mechanism and also is interconnected to the toilet seat, such that motion of the motor in a first direction causes the seat lift linkage to move the toilet seat from one position, corresponding to a seated position, to a second position, corresponding to an elevated position and wherein the drive mechanism includes a motor output sprocket, a drive sprocket, a plurality of power transfer sprockets, a power transfer axle, a plurality of drive axles, a drive chain and a plurality of power transfer chains.

2. The toilet seat lifting device of claim 1, wherein the motor output sprocket is secured to the output shaft of the motor and also is interconnected to the drive sprocket by means of the drive chain.

3. The toilet seat lifting device of claim 2, wherein the drive sprocket and one power transfer sprocket are secured to one drive axle.

4. The toilet seat lifting device of claim 3, wherein a power transfer sprocket also is secured to another drive axle and to each end of the power transfer axle.

5. The toilet seat lifting device of claim 4, wherein a power transfer chain interconnects respectively the power transfer sprocket at one end of the power transfer axle and the power transfer sprocket secured to one drive axle.

6. The toilet seat lifting device of claim 5, wherein another power transfer chain interconnects respectively the power transfer sprocket at the other end of the power transfer axle and the power transfer sprocket secured to another drive axle.

7. A toilet seat lifting device comprising:

(a) a toilet seat.

(b) a motor, (c) a drive mechanism, and (d) seat lift linkage:

wherein the seat lift linkage is operably interconnected to the motor by the drive mechanism and also is interconnected to the toilet seat, such that motion of the motor in a first direction causes the seat lift linkage to move the toilet seat from one position, corresponding to a seated position, to a second position, corresponding to an elevated position;

said toilet seat lifting device further comprising a support frame, wherein pairs of arms comprising, respectively, one lower arm and one upper arm are pivotably interconnected to each other at the first end thereof; and wherein the second end of each lower arm is secured to the drive axles, so the corresponding drive axle rotates the second end of each lower arm.

8. The toilet seat lifting device of claim 7, wherein the second end of each upper arm is pivotably interconnected to the toilet seat at one end thereof, more specifically the end opposite to the point at which the toilet seat is pivotably interconnected to the support frame, whereby selective operation of the motor by the user cause this end of the toilet seat to be selectively raise or lowered.

* * * * *